United States Patent [19]

Harrington et al.

[11] Patent Number: 4,834,401

[45] Date of Patent: May 30, 1989

[54] FUEL TANK ASSEMBLY FOR A REFRIGERATED CONTAINER

[75] Inventors: Robert L. Harrington, Eden Prairie; Dennis F. Feldhake, Prior Lake; Bradley G. Ellingson, Bloomington; Virgil D. Leinum, Jordan; Thomas J. Niemi, Minneapolis, all of Minn.

[73] Assignee: Thermo King Corporation, Minneapolis, Minn.

[21] Appl. No.: 193,696

[22] Filed: May 13, 1988

[51] Int. Cl.[4] ..... F16M 13/00

[52] U.S. Cl. ..... 280/833; 248/228

[58] Field of Search ..... 220/1 B, 5 A, 18, 85 S; 280/5 H, 5 A, 5 E; 248/228

[56] References Cited

U.S. PATENT DOCUMENTS 2,865,585 12/1958 Beyer et al. ..... 248/228 X 3,894,705 7/1975 Glassmeyer ..... 280/5 H X 4,088,079 5/1978 Herzog ..... 248/228 X

*Primary Examiner*—A. Michael Chambers

*Assistant Examiner*—John C. Fox

*Attorney, Agent, or Firm*—D. R. Lackey

[57] ABSTRACT

A fuel tank assembly which includes a fuel tank mounted below spaced I-beams of a refrigerated container chassis during a land transportation mode in which an engine driven generator provides electrical power for driving a refrigeration compressor. The fuel tank is mounted within about 0.5 inch of the lower flanges of the I-beams, to provide maximum road clearance, by a mounting arrangement which projects tank hangers above the level of the lower flanges of the I-beams, and by mounting brackets which extend downwardly from the tank hangers to rest upon the lower inner flange portions of the I-beams.

9 Claims, 4 Drawing Sheets

FUEL TANK ASSEMBLY FOR A REFRIGERATED CONTAINER

TECHNICAL FIELD

The invention relates in general to refrigerated containers, and more specifically to a fuel tank assembly for such containers for use during land transporation thereof.

BACKGROUND ART

Refrigerated containers include a refrigeration system in which an electrical motor drives a refrigeration compressor. When the containers are aboard a ship, the ship electrical system provides electrical power for the motors. When a container is being transported by a truck to or from a shipyard, an internal combustion driven electrical generator may be attached to the container, with this "gen. set" providing the electrical power for operating the compressor drive motor. A fuel tank for providing fuel for the internal combustion engine must also be fixed to the container. The mounting arrangement for the fuel tank should facilitate the connection and removal of the fuel tank, it should reliably fix the fuel tank to the container, and it should provide as much road clearance between the bottom of the fuel tank and the road as possible.

In the prior art, fuel tank hangers which support fuel tank mounting straps are mounted against the bottom surfaces of a pair of I-beams which extend across the bottom of the container chassis.

DISCLOSURE OF THE INVENTION

Briefly, the present invention is a fuel tank assembly for a container in which the top of the fuel tank is raised several inches, compared with prior art fuel tank mounting arrangements. Thus, the fuel tank assembly of the invention provides additional road clearance for a given tank diameter, or it enables a larger diameter fuel tank to be used for a given road clearance, as desired.

The fuel tank assembly of the present invention places the fuel tank hanger and strap assemblies between the spaced I-beams of the container chassis, instead of directly below them, elevating bracket mounting portions of the hangers well above the level of the lower inner flanges of the I-beams. The weight of the fuel tank is supported on the lower inner flanges of the I-beams by mounting brackets which extend downwardly from the bracket mounting portions of the hangers to the lower inner flanges of the I-beams.

Horizontally extending leg portions of the mounting brackets snugly but slidably extend under the bottom surfaces of the I-beams to enable the uppermost surface of the fuel tank to extend almost to the bottom surfaces of the I-beams, separated only by these horizontally extending leg portions of the mounting brackets.

The mounting brackets are removably clamped to the I-beams, to prevent the fuel tank assembly from sliding along the I-beams. The clamping arrangement includes a first clamp member which is movable towards a fixed or second clamp member by actuating a screw. Actuating the screw to urge the movable clamp member towards the fixed clamp member forces the movable clamp member against a lower outer flange portion of an I-beam. The fixed clamp member of the clamping arrangement depends from the horizontally extending leg portion of a mounting bracket which is disposed below the bottom surface of the I-beam.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
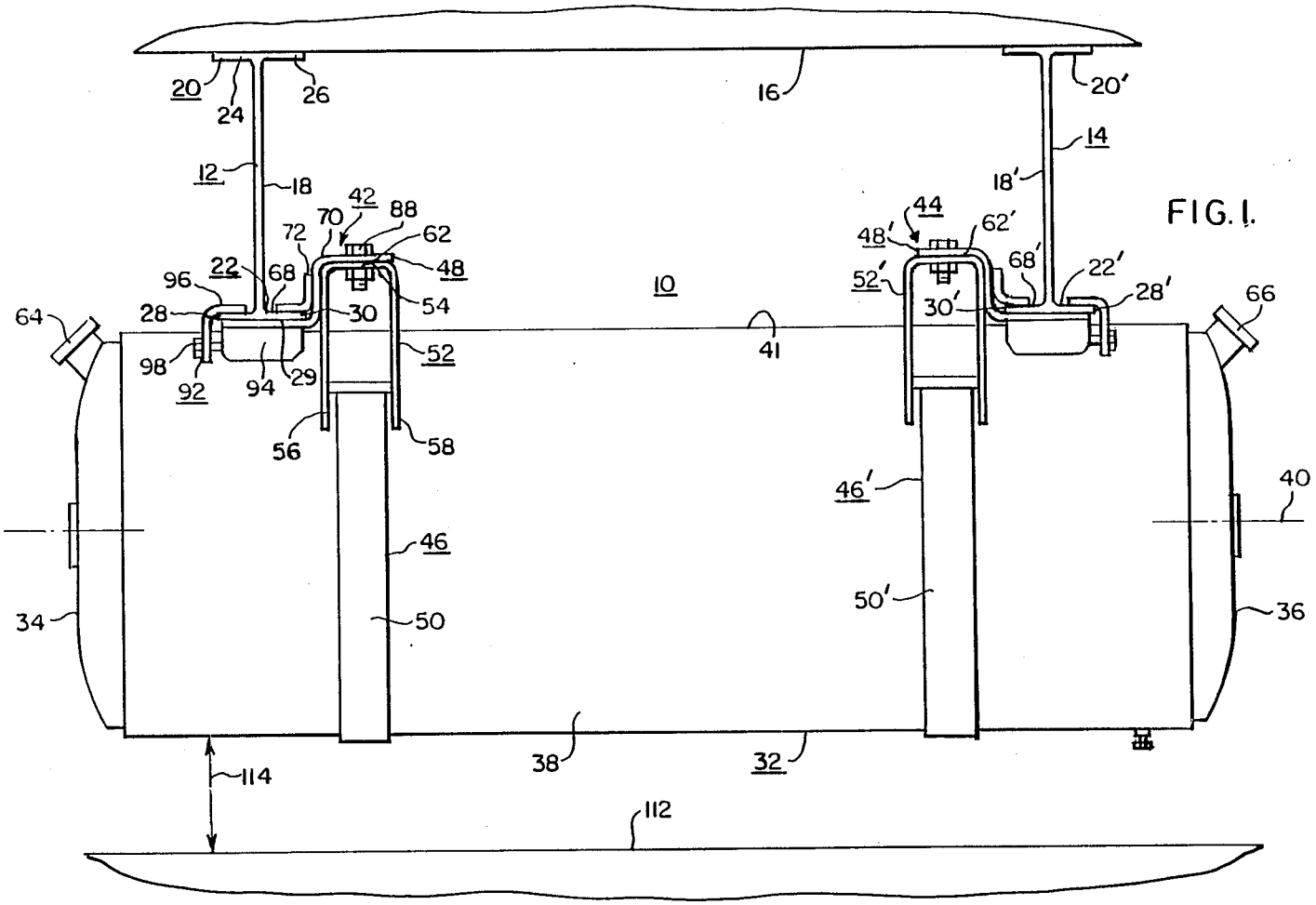
FIG. 1 is a side elevational view of a fuel tank assembly suspended from container chassis I-beams according to the teachings of the invention.
Figure 2:
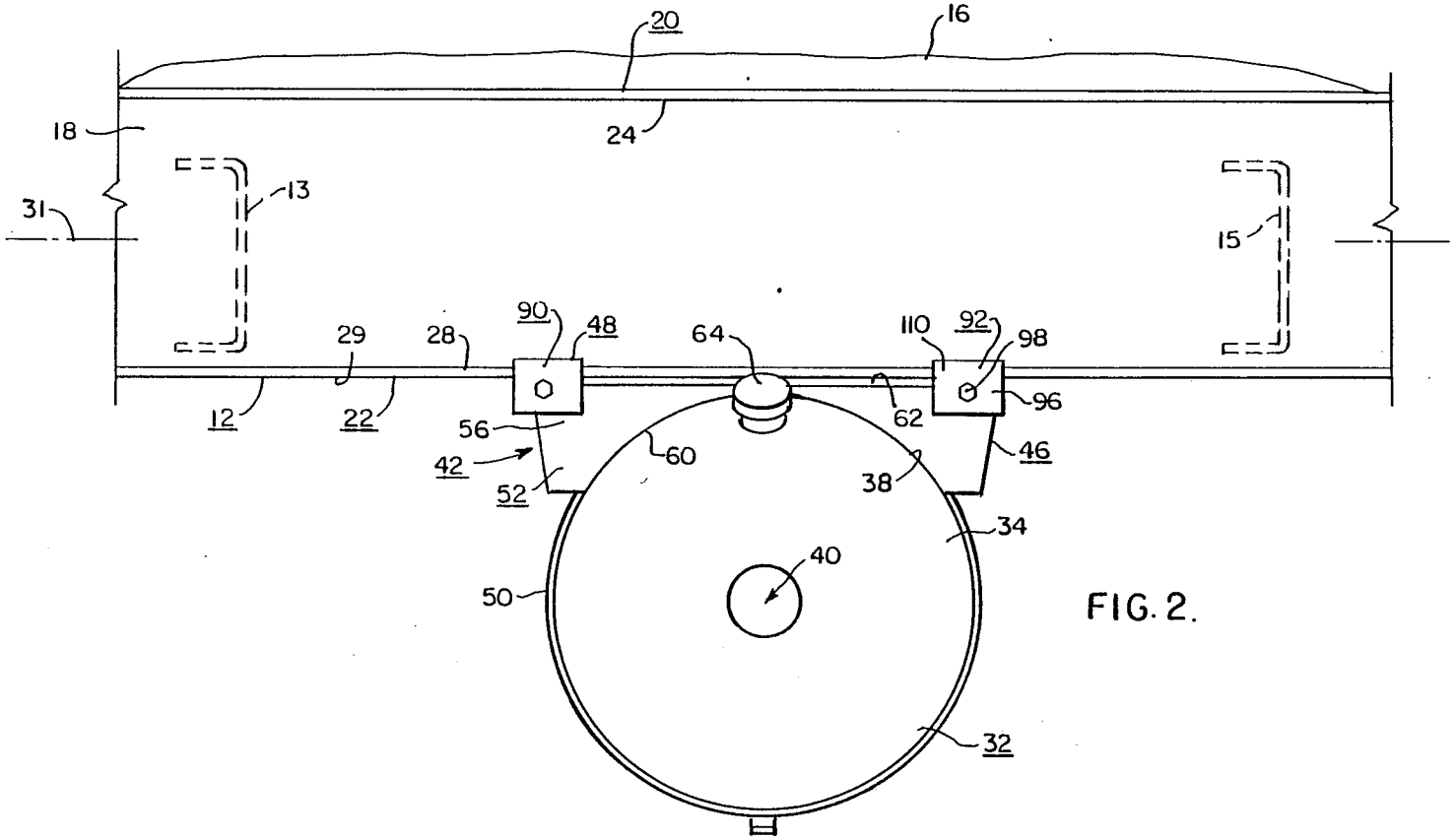
FIG. 2 is an end elevational view of the fuel tank assembly shown in FIG. 1.

Referring now to the drawings, and to FIGS. 1 and 2 in particular, there is shown in side and end elevational views, respectively, a fuel tank assembly 10 constructed according to the teachings of the invention. Fuel tank assembly 10 is mounted below first and second spaced parallel I-beams 12 and 14, respectively, of a refrigerated container chassis 16. The container chassis 16 per se forms no part of the present invention, and thus will not be described in detail. U.S. Pat. No. 4,663,725, which is assigned to the same assignee as the present application, illustrates a shipping container refrigeration system. Thus, for the purposes of the present invention it is sufficient to illustrate I-beams 12 and 14 which support the container chassis 16. A plurality of chassis cross members extend between I-beams 12 and 14, such as cross members 13 and 15 illustrated in FIG. 2.

Refrigerated shipping containers normally include an electrical motor which drives a refrigerant compressor, with electrical power for the motor being provided by a shipboard electrical system. When the refrigerated container is being transported over land to or from a ship by a truck designed to haul refrigerated containers, a generator set which includes an internal combustion engine coupled to an electrical generator, provides electrical power for the compressor drive motor. The present invention relates to the fuel tank assembly 10 which supplies fuel to the internal combustion engine of the generator set.

Each of the container chassis I-beams, such as I-beam 12, includes a vertically oriented web 18 and upper and lower flanges 20 and 22, respectively. Each upper flange 20 includes outer and inner flange portions 24 and 26, respectively, with "outer" and "inner" being referenced to the position of the flange portions relative to the other I-beam. In like manner each lower flange 22 includes outer and inner flange portions 28 and 30, respectively, and a surface 29 which extends across the bottom of the lower flange 22. The longitudinal axes of I-beams 12 and 14, such as longitudinal axis 31 of I-beam 12, are oriented in spaced parallel relation with one another.

Fuel tank assembly 10 includes a cylindrical fuel tank 32 having first and second axial ends 34 and 36, respectively, a curved outer surface or sidewall 38, a longitudinal axis 40, and a top 41 which is the uppermost portion of tank sidewall 38 when tank 32 is properly oriented. Fuel tank 32 is mounted on I-beams 12 and 14 via mounting means 42 and 44, respectively, with longitudinal axis 40 of fuel tank 32 oriented transversely to the longitudinal axes of I-beams 12 and 14, such as longitudinal axis 31.

Mounting means 42 and 44 are of like construction, and thus only mounting means 42 will be described in detail. The components of mounting means 44 will utilize the same reference numerals used for the components of mounting means 42, with the addition of a prime mark.

More specifically, mounting means 42 includes a mounting strap assembly 46 and a mounting bracket 48. Mounting strap assembly includes a mounting strap 50 and a hanger 52. Hanger 52 is channel shaped in cross section, having a bight 54 and first and second spaced depending leg portions 56 and 58. The lower ends of the leg portions 56 and 58, such as lower end 60 of leg portion 56, are curved to snugly fit or contact the curved contour of tank sidewall 38. Bight 54 includes a flat upper surface 62 which functions as a bracket mounting portion of hanger 52. Mounting strap 50 has its ends suitably fixed to hanger 52, with the resulting strap/hanger assembly 46 snugly encompassing side wall 38 of tank 32. Filler spouts 64 and 66 are located at axial ends 34 and 36, respectivly, closely adjacent to sidewall 38. An imaginary line drawn between spouts 64 and 66 across side wall 38 indictes the top 41 of tank 32. Strap/hanger assembly 46 is circumferentially oriented about side wall 38 such that flat mounting surface 62 of hanger 52 is centered over the top 41 of tank 32, and horizontally oriented.

As illustrated most clearly in FIG. 1, strap/hanger assembly 46 of mounting means 42, and the like strap/-hanger assembly 46' of mounting means 44, are spaced inwardly from axial ends 34 and 36, respectively, of fuel tank 32 by a like dimension. The dimension is selected to enable fuel tank assembly 10, when tank 32 is oriented such that its longitudinal axis 40 is perpendicular to vertical planes disposed through webs 18 and 18' of I-beams 12 and 14, to be vertically elevated such that hangers 52 and 52' will just clear the lower inner flange portions of the I-beams, such as the lower inner flange portion 30 of I-beam 12. Mounting brackets 48 and 48' extend from the mounting strap assemblies 46 and 46' to the lower inner flange portions 30 and 30', respectively, supporting the entire weight of fuel tank 32 and its contents upon upper surfaces 68 and 68' of lower inner flange portions 30 and 30' while maintaining fuel tank 32 in an elevated position which raises top 41 of tank 32 substantially to the I-beams 12 and 14. Top 41 of tank 32 is separated from the I-beams 12 and 14 only by relatively thin structural portions of the mounting brackets 48 and 48', which portions have a thickness dimension of only about 0.5 inch, as will be hereinafter described.

Figure 3:
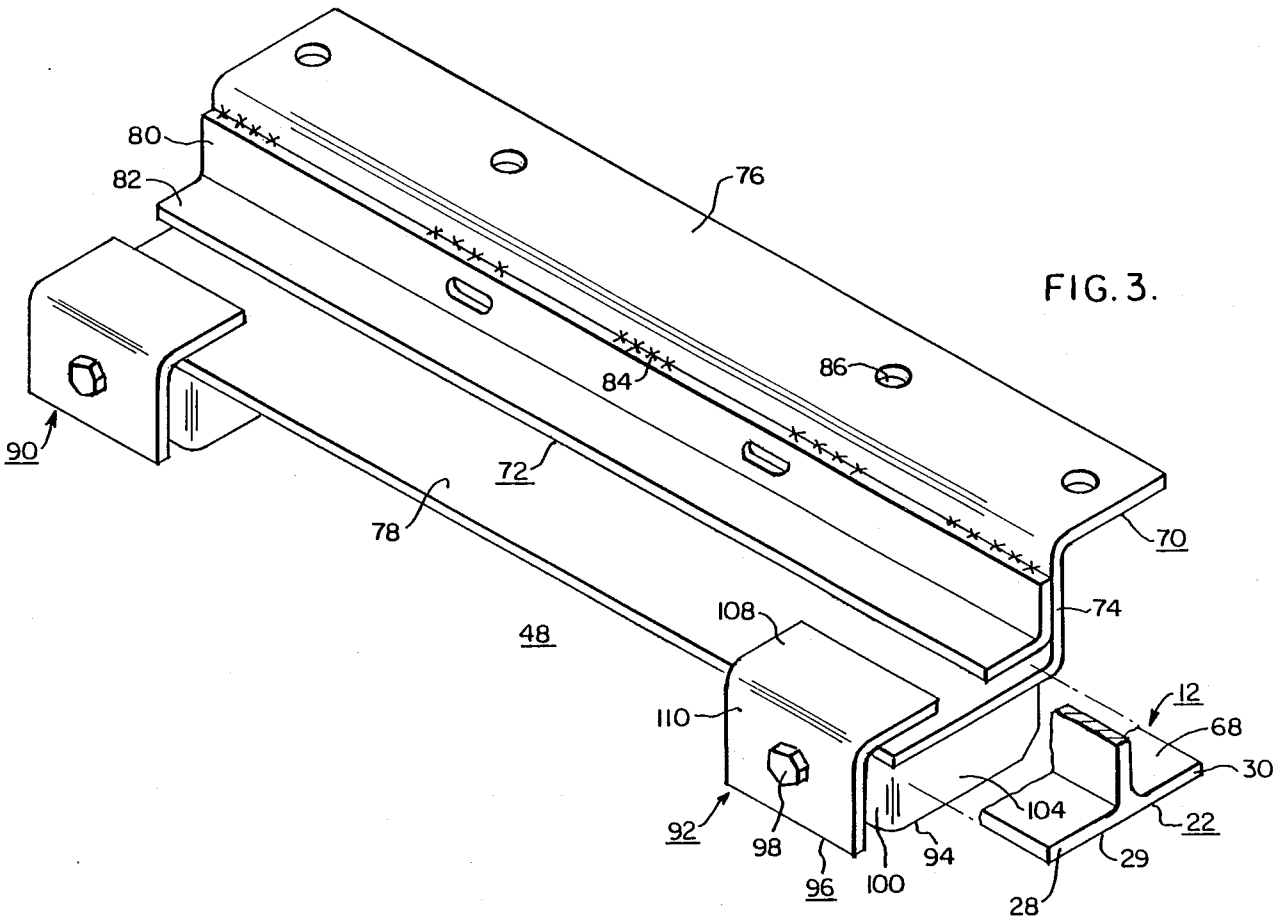
FIG. 3 is a perspective view of a bracket portion of the fuel tank assembly shown in FIGS. 1 and 2.
Figure 5:
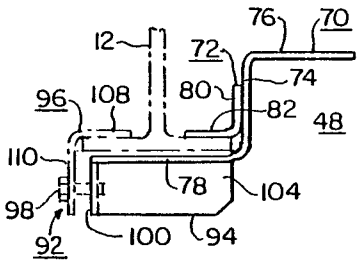
FIG. 5 is an end elevational view of the bracket portion shown in FIG. 4, with the movable portion of a clamping device and associated I-beam being shown in phantom.
Figure 6:
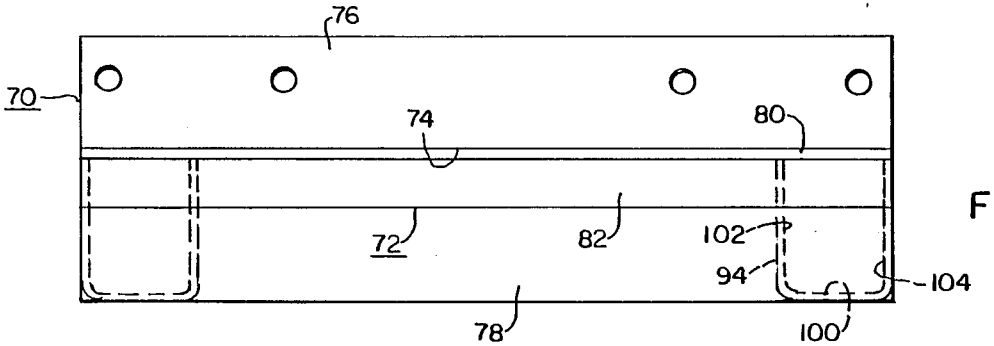
FIG. 6 is a top view of the bracket portion shown in FIG. 4.
Figure 4:
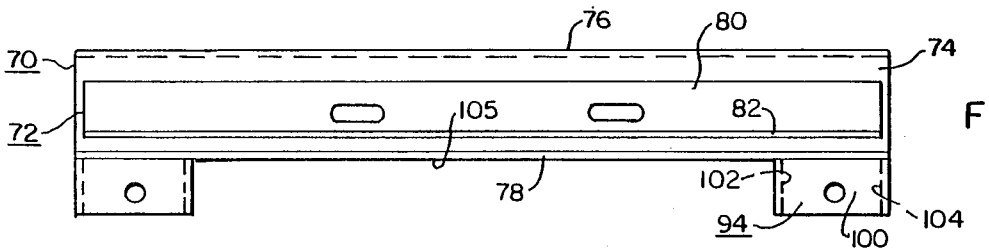
FIG. 4 is a front elevational view of the bracket portion shown in FIG. 3, without movable portions of a pair of clamping devices shown in FIG. 3.
Figure 7:
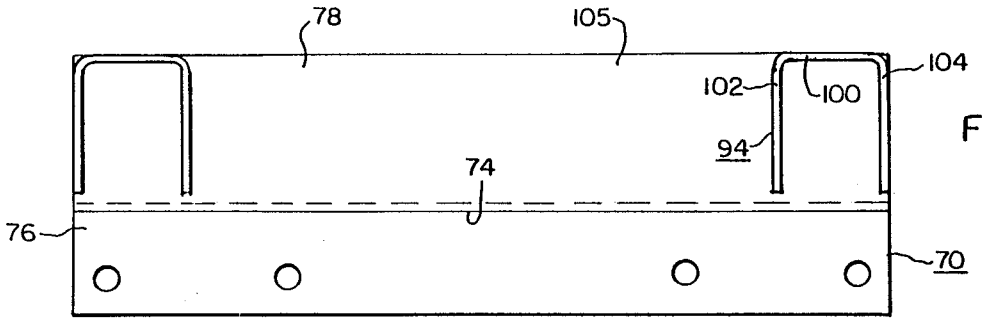
FIG. 7 is a bottom view of the bracket portion shown in FIG. 4.

More specifically, mounting bracket 48 includes first and second elongated support members 70 and 72, respectively, which are shown most clearly in the perspective view of mounting bracket 48 in FIG. 3, as well as in the elevational and plan views of mounting bracket 48 set forth in FIGS. 4 through 7.

The first elongated support member 70 has a substantially Z-shaped cross sectional configuration, including a vertically oriented web 74 and upper and lower oppositely extending, horizontally oriented legs 76 and 78, respectively.

The second elongated support member 72 has a right angle cross sectional configuration, including a vertically oriented leg 80 and a horizontally oriented leg 82. Vertically oriented leg 80 is fixed to the vertically oriented web 74 of the first elongated support member 70, such as by welding, indicated by weld 84 in FIG. 3. Weld 84 is performed such that the resulting weld joint is sufficiently strong to support the weight of tank 32 and its contents with a large factor of safety. Th second elongated support member 72 is positioned relative to the first elongated support member 70 such that legs 82 and 78 are in vertically spaced parallel relation, with the vertical spacing dimension being selected to enable mounting bracket 48 to snugly but slidably receive the thickness dimension of the lower inner flange portion 30 of I-beam 12, such as 0.38 inch, for example.

The upper horizontally extending leg 76 of the first elongated support member 70 has a plurality of spaced openings formed therein, such as opening 86, and bight 54 of hanger 52 has a plurality of like dimensioned spaced openings (not shown) which are in registry with openings 86 when leg 76 is disposed upon the bracket support surface 62 of bight 54. Nut and bolt assemblies, such as nut and bolt assembly 88, firmly fasten leg 76 of mounting bracket 48 to mounting strap assembly 46.

Thus, to assemble fuel tank assembly 10 with the container chassis 16, mounting brackets 48 and 48' are preassembled with the mounting strap assemblies 46 and 46', respectively. The resulting bracket-strap sub-assemblies are mounted to the chassis I-beams 12 and 14. Tank 32 is then assembled in straps 50 and 50'.

In order to prevent fuel tank assembly 10 from sliding along I-beams 12 and 14 after assembly, each of the mounting brackets 48 and 48' include first and second clamping means, such as first and second clamping means 90 and 92 associated with mounting bracket 48. Since the first and second clamping means 90 and 92 are of like construction, only the second clamping means 92 will be described in detail.

More specifically, clamping means 92 includes a fixed member 94, a movable member 96, and means for urging the movable member 96 towards the fixed member 94, such as a screw or bolt 98.

Fixed member 94 of clamping means 92 depends from the lower horizontally oriented leg 78 of the first elongated support member 70, and is securely fixed thereto, such as by welding. As shown most clearly in FIG. 7, fixed member 94 may be channel shaped, having a vertically oriented bight 100 and legs 102 and 104. Bight 100 and legs 102 and 104 may all be welded to the lower surface 105 of leg 78. Bight 100 has an opening 106 which may be tapped if urging means 98 is a screw, or simply sized to receive a bolt.

Movable member 96 of clamping means 92 has a right angle cross section, including a horizontally oriented leg 108 and a depending, vertically oriented leg 110. Leg 110 includes an opening for receiving screw or bolt 98. When screw or bolt 98 links the fixed and movable members 94 and 96, there is a spacing or vertical dimension between the lower leg 78 of the first elongated support member 70 and the horizontally oriented leg 108 which will slidably but snugly accept the lower outer flange portion 28 of I-beam 12. Thus, after fuel tank assembly 10 is moved along the I-beams 12 and 14 to the desired position, screws 98 of all of the clamping means are actuated to force the movable member 96 tightly against the lower outer flange portion 28 of the associated I-beams, to securely hold the selected position of the fuel tank assembly 10 on the I-beams 12 and 14.

It will be noted in FIG. 1 that tank 32 has been elevated above road 112 by a dimension 114 which is about the maximum that can be achieved, as the top 41 of tank 32 is substantially at the level of the bottom surface 29 of the lower flanges 22 and 22' of I-beams 12 and 14, respectively. Further, the disclosed mounting arrangement enables the fuel tank assembly 10 to be quickly coupled to, and uncoupled from, container chassis 16 with a strong, reliable, non-sliding frictional engagement which utilizes the lower inner flange portions of I-beams 12 and 14 to support the weight of the fuel tank assembly, and the lower outer flange portions to cooperate with clamping devices of the mounting arrangement.

We claim as our invention:

1. A fuel tank assembly mounted below first and second spaced, parallel I-beams of a container chassis, with the first and second I-beams each having a longitudinal axis and a cross-sectional configuration which includes a vertically oriented web and upper and lower flanges each having inner and outer portions, comprising:

a cylindrical tank having first and second axial ends, a curved outer surface, and a longitudinal axis extending between said axial ends, and mounting means supporting said tank from said first and second I-beams, with the longitudinal axis of said tank being transverse to the longitudinal axes of said first and second I-beams, said mounting means including first and second mounting strap assemblies and first and second mounting brackets, with said first and second mounting brackets respectively interconnecting the first and second mounting strap assemblies with the first and second I-beams, said first and second mounting strap assemblies being disposed about said cylindrical tank, between the spaced first and second I-beams, said first and second mounting strap assemblies including bracket mounting hangers respectively connected to the first and second mounting brackets, with said bracket mounting hangers being elevated above the lower inner flange portions of the first and second I-beams, such that the first and second mounting brackets extend downwardly from said bracket mounting hangers and respectively rest upon the lower inner flange portions of the first and second I-beams.

2. The fuel tank assembly of claim 1 including clamp means for clamping at least one of the first and second mounting brackets to the first and second I-beams, to prevent the fuel tank assembly from sliding along the first and second I-beams.

3. The fuel tank assembly of claim 1 wherein each of the bracket mounting hangers of the first and second mounting strap assemblies includes a channel shaped member having a bight and depending leg portions, with said leg portions being configured to contact the curved outer surface of said tank, and with said bight defining a bracket mounting portion.

4. The fuel tank assembly of claim 3 wherein the bracket mounting portion of the bight includes a flat, horizontally oriented mounting surface disposed above the tank.

5. The fuel tank assembly of claim 1 wherein each of the first and second mounting brackets includes first and second elongated support members, said first elongated support member having a substantially Z-shaped cross-sectional configuration, including a vertically oriented web and upper and lower oppositely extending, horizontally oriented leg members, said second elongated support member having a right angle cross sectional configuration, including a vertically oriented leg member secured to the vertically oriented web of the first support member and a horizontally oriented leg member disposed in vertically spaced relation above the lower horizontally oriented leg member of the first support member, such that the horizontally oriented leg member of the second elongated member rests upon a lower inner flange portion of an I-beam, and the upper horizontally oriented leg member of the first elongated support member is fixed to a bracket mounting hanger of a mounting strap assembly.

6. The fuel tank assembly of claim 5 wherein the vertically spaced, horizontally oriented leg members of the first and second support members of the first and second mounting brackets respectively sandwich the lower flanges of said first and second I-beams, with the horizontally oriented lower leg members of the first elongated support members of the first and second mounting brackets being respectively disposed below the lower flanges of the first and second I-beams.

7. The fuel tank assembly of claim 6 including clamp means for clamping at least one of the first and second mounting brackets to an associated I-beam, to prevent the fuel tank assembly from sliding along the first and second I-beams.

8. The fuel tank assembly of claim 7 wherein the clamp means includes a depending member fixed to the lower horizontally oriented leg member of a first elongated support member, a movable member disposed to contact the outer lower flange portion of one of the I-beams, and means for urging the movable member towards the depending member to force the movable member tightly against the outer lower flange portion.

9. The fuel tank assembly of claim 1 including first and second clamping means associated with each of the first and second mounting means for removably fixing the first and second mounting brackets to the outer lower flange portions of the first and second I-beams.

* * * * *